US010249322B2

(12) United States Patent
Nelke et al.

(10) Patent No.: US 10,249,322 B2
(45) Date of Patent: Apr. 2, 2019

(54) AUDIO PROCESSING DEVICES AND AUDIO PROCESSING METHODS

(71) Applicant: Intel IP Corporation, Santa Clara, CA (US)

(72) Inventors: Christoph Nelke, Aachen (DE); Navin Chatlani, Allentown, PA (US); Christophe Beaugeant, Mouans Sartoux (FR); Peter Vary, Aachen (DE)

(73) Assignee: INTEL IP CORPORATION, Santa Clara, CA (US)

( * ) Notice: Subject to any disclaimer, the term of this patent is extended or adjusted under 35 U.S.C. 154(b) by 0 days.

(21) Appl. No.: 15/024,085

(22) PCT Filed: Oct. 16, 2014

(86) PCT No.: PCT/US2014/060791
§ 371 (c)(1),
(2) Date: Mar. 23, 2016

(87) PCT Pub. No.: WO2015/061116
PCT Pub. Date: Apr. 30, 2015

(65) Prior Publication Data

US 2016/0225388 A1 Aug. 4, 2016

(30) Foreign Application Priority Data

Oct. 25, 2013 (DE) ..... 10 2013 111 784

(51) Int. Cl.
*G10K 11/178* (2006.01)
*G10L 25/21* (2013.01)
(Continued)

(52) U.S. Cl.
CPC ..... *G10L 25/21* (2013.01); *G10L 21/0232* (2013.01); *G10L 25/24* (2013.01);
(Continued)

(58) Field of Classification Search
CPC ..... H04R 3/005; H04R 2430/01; H04R 2499/11; H04R 3/04; H04R 2410/05;
(Continued)

(56) References Cited

U.S. PATENT DOCUMENTS 6,438,513 B1 * 8/2002 Pastor ..... G10L 21/0208 702/191
6,859,773 B2 2/2005 Breton
(Continued)

FOREIGN PATENT DOCUMENTS

DE 69503895 T2 2/1999
DE 60203436 T2 2/2006
(Continued)

OTHER PUBLICATIONS

Vary et al., "Digital Speech Transmission: Enhancement, Coding and Error Concealment," John Wiley&Sons, Ltd, 2006, pp. 389-466.
(Continued)

*Primary Examiner* — Norman Yu
(74) *Attorney, Agent, or Firm* — Viering, Jentschura & Partner MBB

(57) ABSTRACT

An audio processing device is described comprising an energy distribution determiner configured to determine an energy distribution of a sound and an acoustical environment determiner configured to determine based on the energy distribution whether the sound includes a sound caused by the acoustical environment.

25 Claims, 8 Drawing Sheets

(51) Int. Cl.

| | |
|---|---|
| ***H04R 3/00*** | (2006.01) |
| ***G10L 25/24*** | (2013.01) |
| ***G10L 21/0232*** | (2013.01) |
| ***H04R 3/04*** | (2006.01) |
| *G10L 21/0208* | (2013.01) |
| *G10L 25/51* | (2013.01) |

(52) U.S. Cl.
CPC ..... *H04R 3/00* (2013.01); *H04R 3/04* (2013.01); *G10L 25/51* (2013.01); *G10L 2021/02082* (2013.01); *H04S 2400/15* (2013.01)

(58) Field of Classification Search
CPC ..... H04R 2201/003; H04R 25/407; H04R 29/00; H04R 1/1083; H04R 2225/41; H04R 2225/43; H04R 2430/03; H04R 2460/01; H04R 25/30; H04R 25/505; H04R 29/005; H04R 5/033; G10L 21/0208; G10L 25/84; G10L 21/0232; G10L 15/20; G10L 21/0205; G10L 21/0216; G10L 25/51; G10L 25/78; G10L 21/02; G10L 21/0364; G10L 19/012; G10L 2021/02082; G10L 2021/02166; G10L 2025/937; G10L 25/18; G10L 15/00; G10L 19/02; G10L 19/167; G10L 2021/02085; G10L 2021/02161; G10L 2021/02165; G10L 25/24; H04S 2420/11; H04S 2420/07; H04S 2400/15; H04S 2400/09
USPC ..... 704/226, 233, 500, 205, 94; 381/71.1, 381/56, 58, 98, 71.9–71.12, 94.1, 94.7; 455/570
See application file for complete search history.

(56) References Cited

U.S. PATENT DOCUMENTS

| | | | | |
|---|---|---|---|---|
| 7,889,874 | B1 * | 2/2011 | Ayad | G10K 11/00 381/94.1 |
| 2001/0044719 | A1 | 11/2001 | Casey | |
| 2002/0035471 | A1 | 3/2002 | Breton | |
| 2008/0270127 | A1 * | 10/2008 | Kobayashi | G10L 15/065 704/226 |
| 2009/0154726 | A1 * | 6/2009 | Taenzer | G10L 25/78 381/94.1 |
| 2010/0017205 | A1 * | 1/2010 | Visser | G10L 21/02 704/225 |
| 2011/0004470 | A1 * | 1/2011 | Konchitsky | G10L 21/0208 704/226 |
| 2012/0084085 | A1 | 4/2012 | Wang | |
| 2012/0089393 | A1 * | 4/2012 | Tanaka | G10L 25/87 704/231 |
| 2013/0010982 | A1 | 1/2013 | Elko et al. | |
| 2013/0144614 | A1 * | 6/2013 | Myllyla | G10L 19/0208 704/210 |
| 2013/0251159 | A1 * | 9/2013 | Buck | H04R 3/005 381/56 |
| 2014/0314241 | A1 * | 10/2014 | Penhune | G10K 11/178 381/71.1 |
| 2016/0203833 | A1 * | 7/2016 | Zhu | G10L 25/78 704/233 |

FOREIGN PATENT DOCUMENTS

| | | | |
|---|---|---|---|
| DE | 60123161 | T2 | 9/2007 |
| EP | 1092964 | B1 | 12/2007 |
| EP | 1700294 | B1 | 8/2009 |
| EP | 2226794 | A1 | 9/2010 |
| EP | 1703471 | B1 | 5/2011 |
| FR | 2765715 | A1 | 1/1999 |
| KR | 20070037439 | A | 4/2007 |
| WO | 9529413 | A1 | 11/1995 |
| WO | 2005064595 | A1 | 7/2005 |
| WO | 2005109404 | A2 | 11/2005 |

OTHER PUBLICATIONS

Kates, "Digital Hearing Aids", Plural Publishing, 2008, pp. 147-173.
Hess, "Pitch Determination of Speech Signals", Springer-Verlag, 1983, 713 pages.
Seo et al., "Audio Fingerprinting Based on Normalized Spectral Subband Centroids"; 2005 IEEE international conference on Acoustics, Speech and Signal Processing, Mar. 18-23, 2005, pp. III-213-III-216, vol. 3.
Office Action received for the corresponding DE Patent Application No. 10 2013 111 784.8 dated May 19, 2014, 7 pages of Office Action and 4 pages of English translation.
International Search Report received for the PCT Application No. PCT/US2014/060791 dated Jan. 16, 2015, 5 pages.
Nelke et al., "Single Microphone Wind Noise Reduction Using Techniques of Artificial Bandwidth Extension", 20th European Signal Processing Conference (EUSIPCO 2012), Aug. 27-31, 2012, pp. 2328-2332, Bucharest, Romania.
Erkelens et al., "Minimum mean-square error estimation of discrete fourier coefficients with generalized gamma priors", IEEE Transactions on Audio, Speech, and Language Processing, Aug. 2007, pp. 1741-1752, vol. 15, No. 6.
Hendriks et al., "MMSE based noise Psd tracking with low complexity," in Proc. of IEEE Intern. Conf. on Acoustics, Speech, and Signal Process. (ICASSP), 2010, pp. 4266-4269, Dallas, Texas, USA.
Martin, "Noise power spectral density estimation based on optimal smoothing and minimum statistics," IEEE Transactions on Speech and Audio Processing, Jul. 2001, pp. 504-512, vol. 9, No. 5.
King et al., "Coherent modulation comb filtering for enhancing speech in wind noise," in Proc. of Intern. Workshop on Acoustic Echo and Noise Control (IWAENC), 2008, 4 pages, Seattle, Washington, USA.
Jax et al., "Bandwidth extension of speech signals: a catalyst for the introduction of wideband speech coding?", IEEE Communications Magazine, May 2006, pp. 106-111, vol. 44, No. 5.
Gonzalez et al., "A pitch estimation filter robust to high levels of noise (PEFAC)", in Proc. of the 19th European Signal Processing Conference (EUSIPCO 2011), Aug. 29-Sep. 2, 2011, pp. 451-455, Barcelona, Spain.
Noll, "Pitch determination of human speech by the harmonic product spectrum, the harmonic sum spectrum, and a maximum likelihood estimate", in Proc. of the Symposium on Computer Processing in Communications, 1970, 19 pages, vol. 14, New York, USA.
Plante et al., "A pitch extraction reference database", 4th European Conference on Speech Communication and Technology, Eurospeech '95, Sep. 18-21, 1995, pp. 837-840, Madrid, Spain.
Boll, "Suppression of acoustic noise in speech using spectral subtraction", IEEE Transactions on Acoustics, Speech, and Signal Processing, Apr. 1979, pp. 113-120, vol. ASSP-27, No. 2.
Gerkmann et al., "Noise Power Estimation Based on the Probability of Speech Presence", Proc. of IEEE Workshop on Applications of Signal Processing to Audio and Acoustics (WASPAA), Oct. 16-19, 2011, pp. 145-148, New Paltz, New York, USA.
Nemer et al., "Single-microphone wind noise reduction by adaptive posthltering," in Proc. of IEEE Workshop on Applications of Signal Processing to Audio and Acoustics (WASPAA), Oct. 18-21, 2009, pp. 177-180, New Paltz, New York, USA.
Rix et al., "Perceptual evaluation of speech quality (PESQ)—a new method for speech quality assessment of telephone networks and codecs", in Proc. of IEEE Intern. Conf. on Acoustics, Speech, and Signal Process. (ICASSP), 2001, 4 pages.

(56) References Cited

OTHER PUBLICATIONS

Kobayashi et al., "A weighted autocorrelation method for pitch extraction of noisy speech", in Proc. of IEEE Intern. Cont. on Acoustics, Speech, and Signal Process. (Icassp), 2000, pp. 1307-1310, Istanbul, Turkey.
Ross et al., "Average magnitude difference function pitch extractor," IEEE Transactions on Acoustics, Speech, and Signal Processing, Oct. 1974, pp. 353-362, vol. ASSP-22, No. 5.
Hofmann et al., "A Morphological Approach to Single-Channel Wind-Noise Suppression", Proc. of Intern. Workshop on Acoustic Signal Enhancement, Sep. 4-6, 2012, 4 pages, Aachen, Germany.
Kuroiwa et al., "Wind noise reduction method for speech recording using multiple noise templates and observed spectrum fine structure", International Conference on Communication Technology, 2006, 5 pages.
Noll, "Cepstrum Pitch Determination", Journal of the Acoustical Society of America (JASA), 1967, pp. 293-309, vol. 41, No. 2.
ANSI S3.5-1997, "Methods for calculation of the speech intelligibility index", 1997, 35 pages, American National Standards Institute, New York, USA.
Nelke et al., "Single microphone wind noise PSD estimation using signal centroids", IEEE ICASSP, May 2014, 5 pages, Florence, Italy.

* cited by examiner

AUDIO PROCESSING DEVICES AND AUDIO PROCESSING METHODS

RELATED APPLICATIONS

The present application is a national stage entry according to 35 U.S.C. § 371 of PCT application No.: PCT/US2014/060791 filed on Oct. 16, 2014 which claims priority from German application No.: 10 2013 111 784.8 filed on Oct. 25, 2013, and is incorporated herein by reference in its entirety.

TECHNICAL FIELD

Various aspects of this disclosure generally relate to audio processing devices and audio processing methods.

BACKGROUND

The advantage to use mobile communication devices in almost every situation often leads to extreme acoustical environments. An annoying factor is the occurrence of noise which is also picked up by the microphone during a conversation. Wind noise represents a special class of noise signals because it is directly generated by the turbulences created by a wind stream around the communication device. In the case where a speech signal is superposed by wind noise, the quality and intelligibility during a conversation can be greatly degraded. Because most mobile devices do not offer space for a wind screen, it is necessary to develop systems which can reduce the effects of wind noise.

BRIEF DESCRIPTION OF THE DRAWINGS

In the drawings, like reference characters generally refer to the same parts throughout the different views. The drawings are not necessarily to scale, emphasis instead generally being placed upon illustrating the principles of various aspects of this disclosure. In the following description, various aspects are described with reference to the following drawings, in which.

DESCRIPTION OF EMBODIMENTS

Figure 1A:
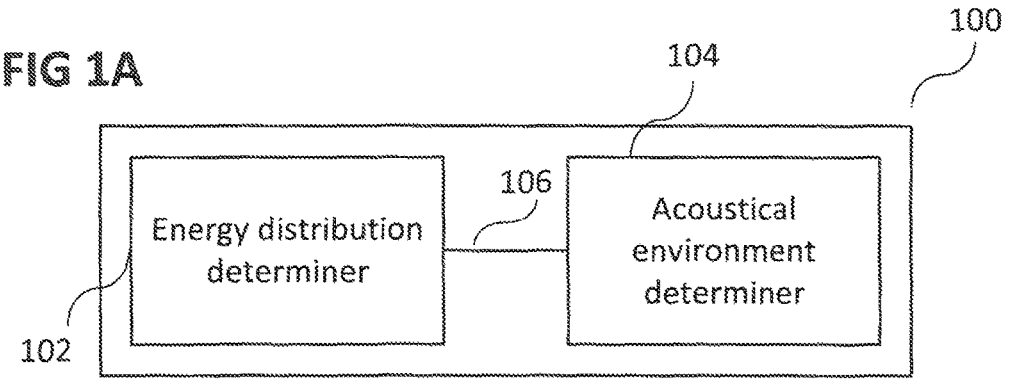
FIG. 1A and FIG. 1B show an audio processing device.

The following detailed description refers to the accompanying drawings that show, by way of illustration, specific details and aspects of this disclosure in which various aspects of this disclosure may be practiced. Other aspects may be utilized and structural, logical, and electrical changes may be made without departing from the scope of the various aspects of this disclosure. The various aspects of this disclosure are not necessarily mutually exclusive, as some aspects of this disclosure can be combined with one or more other aspects of this disclosure to form new aspects.

The terms "coupling" or "connection" are intended to include a direct "coupling" or direct "connection" as well as an indirect "coupling" or indirect "connection", respectively.

The word "exemplary" is used herein to mean "serving as an example, instance, or illustration". Any aspect of this disclosure or design described herein as "exemplary" is not necessarily to be construed as preferred or advantageous over other aspect of this disclosure or designs.

The audio processing device may include a memory which may for example be used in the processing carried out by the audio processing device. A memory may be a volatile memory, for example a DRAM (Dynamic Random Access Memory) or a non-volatile memory, for example a PROM (Programmable Read Only Memory), an EPROM (Erasable PROM), EEPROM (Electrically Erasable PROM), or a flash memory, for example, a floating gate memory, a charge trapping memory, an MRAM (Magnetoresistive Random Access Memory) or a PCRAM (Phase Change Random Access Memory).

As used herein, a "circuit" may be understood as any kind of a logic implementing entity, which may be special purpose circuitry or a processor executing software stored in a memory, firmware, or any combination thereof. Furthermore, a "circuit" may be a hard-wired logic circuit or a programmable logic circuit such as a programmable processor, for example a microprocessor (for example a Complex Instruction Set Computer (CISC) processor or a Reduced Instruction Set Computer (RISC) processor). A "circuit" may also be a processor executing software, for example any kind of computer program, for example a computer program using a virtual machine code such as for example Java. Any other kind of implementation of the respective functions which will be described in more detail below may also be understood as a "circuit". It may also be understood that any two (or more) of the described circuits may be combined into one circuit.

Description is provided for devices, and description is provided for methods. It will be understood that basic properties of the devices also hold for the methods and vice versa. Therefore, for sake of brevity, duplicate description of such properties may be omitted.

It will be understood that any property described herein for a specific device may also hold for any device described herein. It will be understood that any property described herein for a specific method may also hold for any method described herein.

The advantage to use mobile communication devices in almost every situation often leads to extreme acoustical environments. An annoying factor is the occurrence of noise which is also picked up by the microphone during a conversation. Wind noise represents a special class of noise signals because it is directly generated by the turbulences created by a wind stream around the communication device. In the case where a speech signal is superposed by wind noise the quality and intelligibility during a conversation can be greatly degraded. Because most mobile devices do not offer space for a wind screen, it is necessary to develop systems which can reduce the effects of wind noise.

Presently, single-channel speech enhancement systems in mobile communication devices are used to reduce the level of noise from noisy speech signals. The reduction of wind noise using a single microphone signal is a challenging problem since wind noise strongly differs from other acoustical noise signals which may occur during a conversation. As wind noise is generated by a turbulent air stream, it is strongly transient and thus difficult to reduce especially with only one microphone. Many methods have been proposed for general reduction of background noise in speech signals. While those approaches show good performance for many types of noise signals, they only slightly reduce wind noise due to its non-stationary characteristic. Recently other methods were especially designed for wind noise reduction. However, these methods show a high computational complexity or are constrained by the requirement to use two or more microphones, whereas the devices (e.g. systems) and methods according to the present disclosure are not limited by this constraint. Commonly used approaches usually are constrained to using more than one microphone and have high complexity. No existing approach has been documented to be robust to microphone cut-off frequencies.

According to various aspects of this disclosure, devices and methods may be provided to attenuate the wind noise without distorting the desired speech signal. While there are existing solutions using two or more microphones, the approach according to this disclosure is designed to perform wind noise reduction from a single microphone. This system is designed to be scalable to the high pass characteristic of the used microphone.

The devices (for example a system, for example an audio processing device) and methods according to the present disclosure may be capable to detect wind noise and estimate the current noise power spectral density (PSD). This PSD estimate is used for the wind noise reduction. Evaluation with real measurements showed that the system ensures a good balance between noise reduction and speech distortion. Listening tests confirmed these results.

FIG. 1A shows an audio processing device 100. The audio processing device 100 may include an energy distribution determiner 102 configured to determine an energy distribution of a sound. The audio processing device 100 may further include a acoustical environment determiner 104, for example a wind determiner, configured to determine based on the energy distribution whether the sound includes a sound caused by acoustical environment such as wind. The energy distribution determiner 102 and the acoustical environment determiner 104 may be coupled with each other, for example via a connection 106, for example an optical connection or an electrical connection, such as for example a cable or a computer bus or via any other suitable electrical connection to exchange electrical signals.

In other words, the audio processing device 100 may determine whether a sound includes a noise caused by acoustical environments such as wind based on an energy distribution of the sound.

Figure 1B:
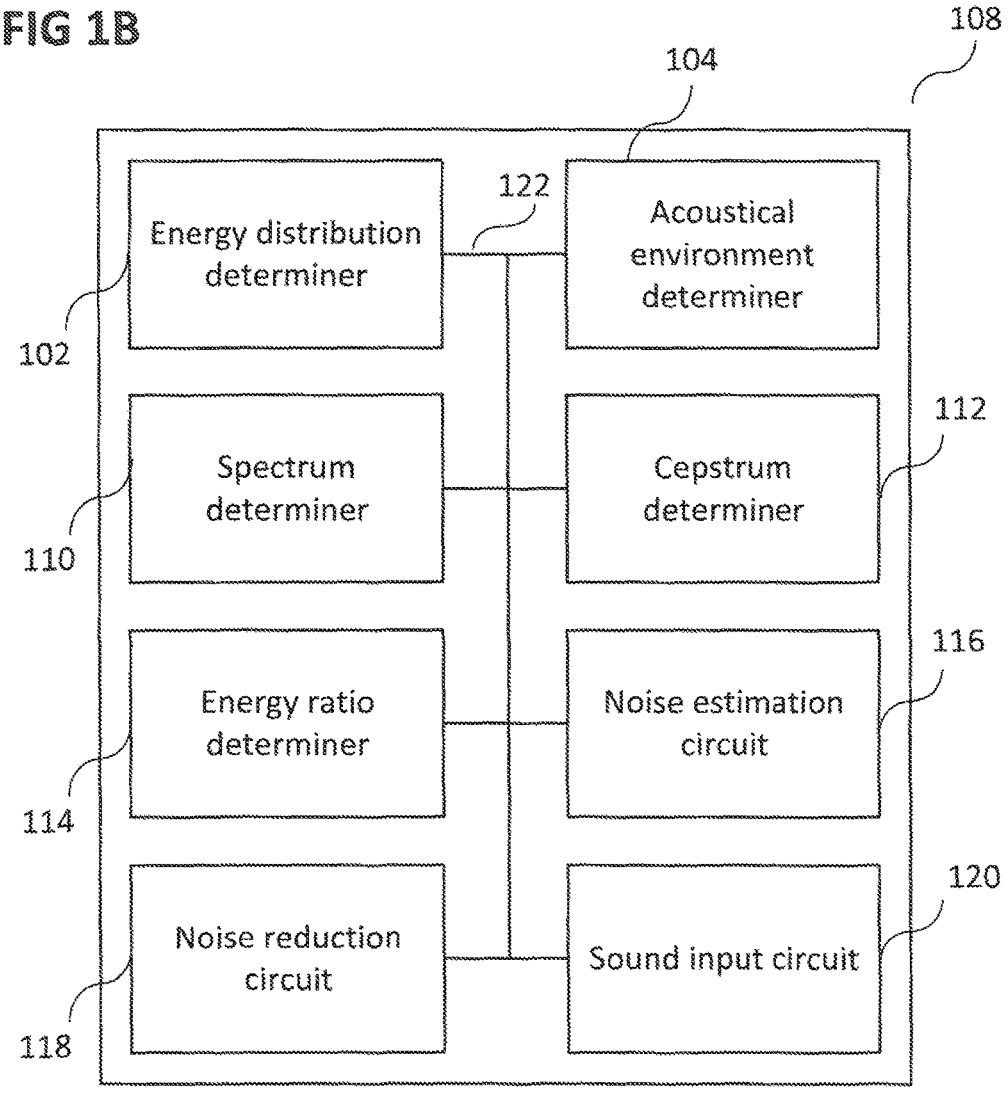

FIG. 1B shows an audio processing device 108. The audio processing device 108 may, similar to the audio processing device 100 of FIG. 1A, include an energy distribution determiner 102 configured to determine an energy distribution of a sound. The audio processing device 108 may, similar to the audio processing device 100 of FIG. 1A, further include an acoustical environment determiner 104 configured to determine based on the energy distribution whether the sound includes a sound caused by an acoustical environment such as wind. The audio processing device 108 may further include a spectrum determiner 110, like will be described in more detail below. The audio processing device 108 may further include a cepstrum determiner 112, like will be described in more detail below. The audio processing device 108 may further include an energy ratio determiner 114, like will be described in more detail below. The audio processing device 108 may further include a noise estimation circuit 116, for example a wind noise estimation circuit, like will be described in more detail below. The audio processing device 108 may further include a noise reduction circuit 118, for example a wind noise reduction circuit, like will be described in more detail below. The audio processing device 108 may further include a sound input circuit 120, like will be described in more detail below. The energy distribution determiner 102, the acoustical environment determiner 104, the spectrum determiner 110, the cepstrum determiner 112, the energy ratio determiner 114, the noise estimation circuit 116, the noise reduction circuit 118, and the sound input circuit 120 may be coupled with each other, for example via a connection 106, for example an optical connection or an electrical connection, such as for example a cable or a computer bus or via any other suitable electrical connection to exchange electrical signals.

The spectrum determiner 110 may be configured to determine a spectrum of the sound.

The spectrum determiner 110 may be configured to perform a Fourier transform of the sound.

The energy distribution determiner 102 may be further configured to determine a spectral energy distribution of the sound. The acoustical environment determiner 104 may be configured to determine based on the spectral energy distribution whether the sound includes a sound caused by acoustical environment such as wind.

The energy distribution determiner 102 may further be configured to determine subband signal centroids of the sound. The acoustical environment determiner 104 may be configured to determine based on the subband signal centroids whether the sound includes a sound caused by acoustical environment such as wind.

The energy distribution determiner 102 may be configured to determine a weighted sum of frequencies present in the sound. The acoustical environment determiner 104 may be configured to determine based on the weighted sum whether the sound includes a sound caused by acoustical environment such as wind.

The cepstrum determiner 112 may be configured to determine a cepstrum transform of the sound.

The acoustical environment determiner 104 may be configured to determine based on the cepstrum transform whether the sound includes a sound caused by acoustical environment such as wind.

The energy ratio determiner 114 may be configured to determine a ratio of energy between two frequency bands.

The acoustical environment determiner 104 may further be configured to classify the sound into one of the following classes: a sound where mainly (or only) sound caused by a first acoustical environment such as wind is present; a sound where mainly (or only) sound caused by a second acoustical environment such as speech is present; or a sound where sound caused by a combination of first and second acoustical environments such as both wind and speech is present.

The noise estimation circuit 116 may be configured to estimate the acoustical environment noise in the audio signal.

The noise estimation circuit 116 may be configured to estimate the noise (for example wind noise) in the audio signal based on a power spectral density.

The noise estimation circuit 116 may further be configured to approximate a noise periodogram (for example a wind noise periodogram) with a polynomial.

The noise reduction circuit 118 may be configured to reduce noise in the audio based on the sound and based on the estimated noise.

The sound input circuit 120 may be configured to receive data representing the sound.

Figure 2:
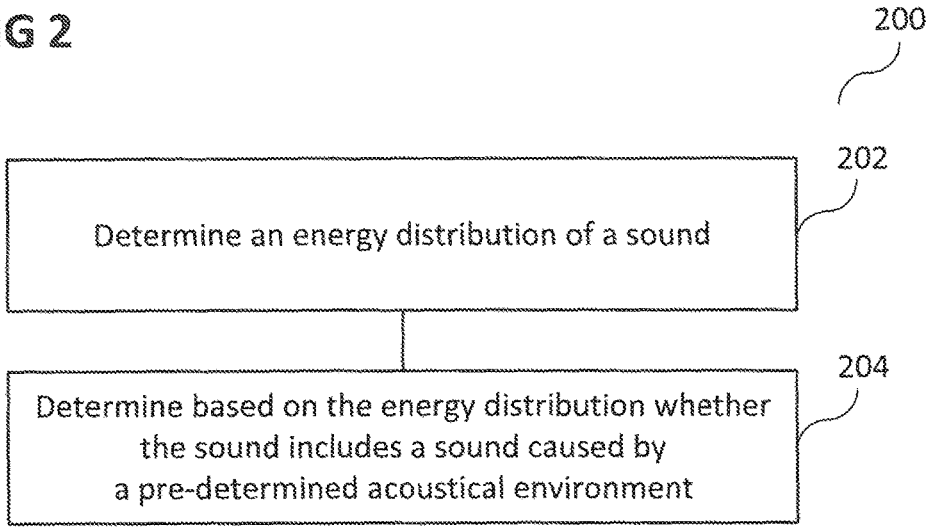
FIG. 2 shows a flow diagram illustrating an audio processing method.

FIG. 2 shows a flow diagram 200 illustrating an audio processing method. In 202, an energy distribution determiner may determine an energy distribution of a sound. In 204, an acoustical environment determiner may determine based on the energy distribution whether the sound includes a sound caused by the acoustical environment such as wind.

The method may further include determining a spectrum of the sound.

The method may further include performing a Fourier transform of the sound.

The method may further include determining a spectral energy distribution of the sound and determining based on the spectral energy distribution whether the sound includes a sound caused by acoustical environment such as wind.

The method may further include determining subband signal centroids of the sound and determining based on the subband signal centroids whether the sound includes a sound caused by acoustical environment such as wind.

The method may further include determining a weighted sum of frequencies present in the sound and determining based on the weighted sum whether the sound includes a sound caused by acoustical environment such as wind.

The method may further include determining a cepstrum transform of the sound.

The method may further include determining based on the cepstrum transform whether the sound includes a sound caused by acoustical environment such as wind.

The method may further include determining a ratio of energy between two frequency bands.

The method may further include determining based on the energy ratio whether the sound includes a sound caused by acoustical environment such as wind.

The method may further include classifying the sound into one of the following classes: a sound where mainly (or only) sound caused by a first acoustical environment such as wind is present; a sound where mainly (or only) sound caused by a second acoustical environment such as speech is present; or a sound where sound caused by a combination of acoustical environments such as wind and speech is present.

The method may further include estimating the noise in the audio signal.

The method may further include estimating the noise in the audio signal based on a power spectral density.

The method may further include approximating a noise periodogram (for example wind noise periodogram) with a polynomial.

The method may further include reducing noise in the audio based on the sound and based on the estimated noise.

The method may further include receiving data representing the sound.

Devices and methods for a single microphone noise reduction exploiting signal centroids may be provided.

Devices and methods may be provided using a Wind Noise Reduction (WNR) technique for noisy speech captured by a single microphone is presented for speech enhancement. These devices and methods may be particularly effective in noisy environments which contain wind noise sources. Devices and methods are provided for detecting the presence of wind noises which contaminate the target speech signals. Devices and methods are provided for estimating the power of these wind noises. This wind noise power estimate may then be used for noise reduction for speech enhancement. The WNR system has been designed to be robust to the lower cut-off frequency of microphones that are used in real devices. The WNR system according to the present disclosure may maintain a balance between the level of noise reduction and speech distortion. Listening tests were performed to confirm the results.

Additionally, the single microphone solution according to the present disclosure may be used as an extension to a dual or multi microphone system in a way that the wind noise reduction is performed independently on each microphone signal before the multi-channel processing is realized.

In the following, a system overview will be given.

Figure 3:
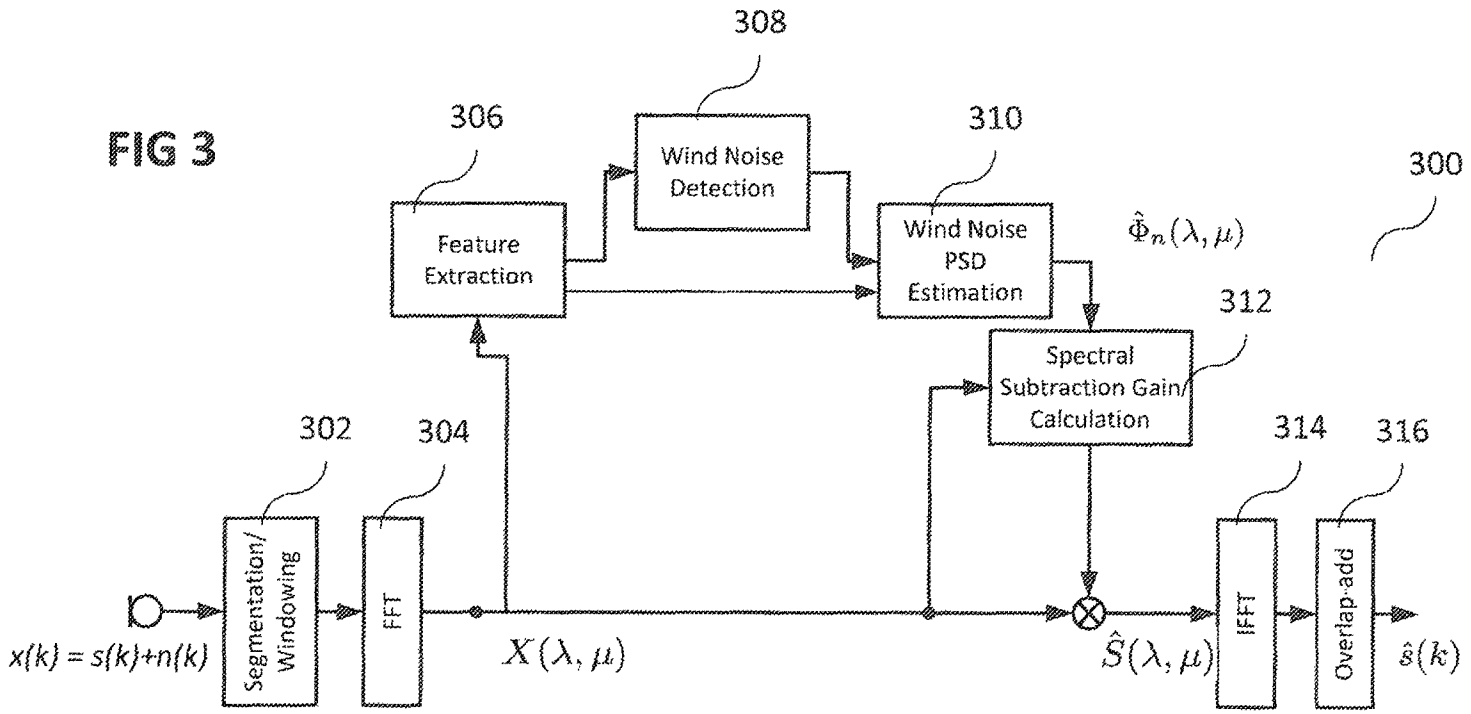
FIG. 3 shows a wind noise reduction system.

FIG. 3 shows a wind noise reduction (WNR) system 300. A segmentation (and/or windowing) circuit 302, a FFT (fast Fourier transform) circuit 304, a feature extraction circuit 306, a wind noise detection circuit 308, a wind noise PSD (power spectral density) estimation circuit 310, a spectral subtraction gain calculation circuit 312, an IFFT (inverse FFT) circuit 314, and an overlap-add circuit 316, like will be described in more detail below, may be provided.

The noisy speech signal x(k) may be modeled by a superposition of the clean speech signal s(k) and the noise signal n(k), where k is the discrete time index of a digital signal. The system may perform noise reduction while reducing the speech distortion. Components of the system according to the present disclosure may be:

i. The detection of wind noise; and ii. The estimation of the wind noise power spectral density (PSD).

In other words: In a basic concept for wind noise estimation according to various aspects of this disclosure, the estimation of the wind noise PSD $\hat{\Phi}_{n}(\lambda,\mu)$ can be divided into two separate steps which are carried out for every frame of the input signal:

i. Wind noise detection (WND), which may include feature extraction (for example computation of the subband signal centroid (SSC) in each frame) and classification of signal frames as clean voiced speech, noisy voiced speech (speech+wind) or pure wind noise based on the extracted feature (for example the SCC value).

ii. Wind noise estimation (WNEST), which may include wind noise periodogram estimation based the signal classification as a) Clean voiced speech: No wind noise estimation;

b) Noisy speech: Minimum search in the spectrum and polynomial fit; or c) Pure wind noise: Use input signal as wind noise periodogram estimate.

The WNEST may further include calculation of an adaptive smoothing factor for the final noise PSD estimate.

These system components may for example be the feature extraction circuit 306, the wind noise detection circuit 308, and the wind noise PSD estimation circuit 310. The system may be configured in a way that these blocks (or circuits) do not show any constraints towards a high pass characteristic of the used microphone. More details on these blocks will be described below.

The single microphone solution according to the present disclosure may be used as an extension to a dual or multi microphone system in a way that the wind noise reduction is performed independently on each microphone signal before the multi-channel processing is realized.

In the methods and devices (for example the system) according to various aspects of this disclosure, an overlap-add framework may be provided. The noise reduction may be realized in an overlap-add structure as shown in FIG. 3. Therefore, the noisy input signal x(k) is first segmented into frames of 20 ms with an overlap of 50% i.e. 10 ms. Afterwards each frame is windowed (e.g. with a Hann window) and transformed in the discrete frequency domain using the Fast Fourier Transform (FFT) yielding $X(\lambda,\mu)$ where $\lambda$ is the frame index and $\mu$ is the discrete frequency bin. The wind noise reduction may be achieved in the frequency domain by multiplying the noisy spectrum $X(\lambda,\mu)$ with spectral gains $G(\lambda,\mu)$. The enhanced signal $\hat{S}(\lambda,\mu)$ may be transformed in the time domain using the Inverse Fast Fourier Transform (IFFT). Finally the overlapping enhanced signal frames are summed up resulting in the output signal $\hat{s}(k)$.

Figure 4:
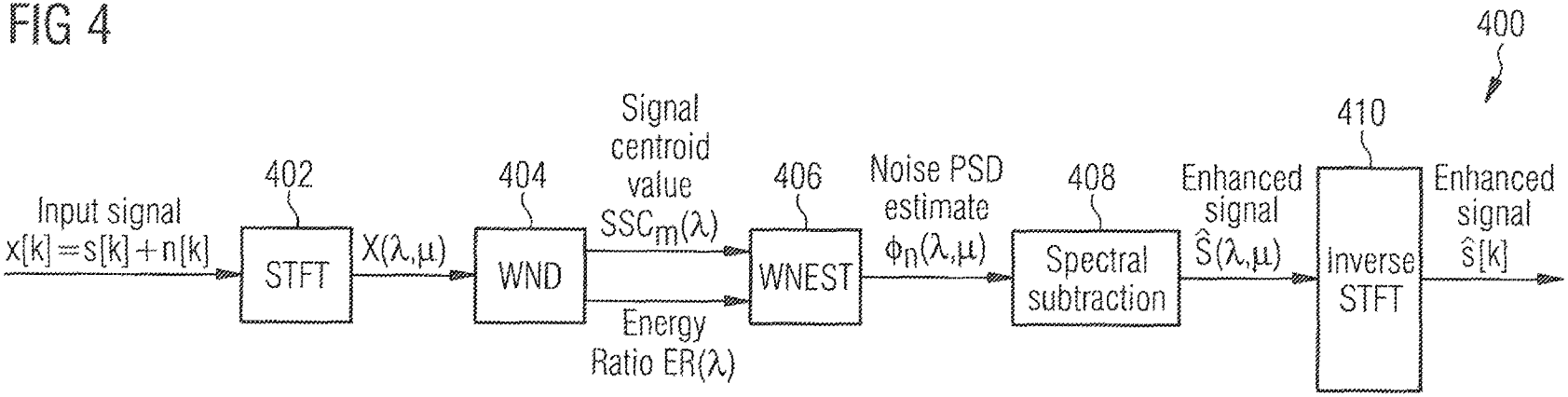
FIG. 4 shows a further wind noise reduction system according to this disclosure.

FIG. 4 shows a further WNR system 400 according to this disclosure. A STFT (short time Fourier transform) circuit 402, a WND (wind noise detection) circuit 404, a WNEST (wind noise estimation) circuit 406, a spectral subtraction circuit 408, and an inverse STFT circuit 410, like will be described in more detail below, may be provided.

In FIG. 4, it can be seen that the WNR according to the present disclosure may (for example first) perform wind noise detection (WND) to extract underlying signal characteristics and features which are used to detect the presence of wind noise. The Signal Sub-band Centroid value $SSC_m(\lambda)$ and the Energy Ration $ER(\lambda)$ may be determined in the WND and used in the Wind Noise Estimation (WNEST) technique to estimate the wind noise power when wind noise is detected. These wind noise components may then be attenuated by performing spectral subtraction. The output enhanced signal $\hat{S}[\lambda, \mu]$ may then be used to reconstruct the output signal using inverse STFT. The WNR system is designed in a way that these blocks do not show any constraints towards a high pass characteristic of the used microphone.

The methods and systems provided may reduce the level of noise in windy situations, thereby improving the quality of voice conversations in mobile communication devices. They may perform noise reduction on spectral components only associated with the wind noise and it typically does not impact any other type of encountered noises or speech. As a result, they may not introduce speech distortion that is commonly introduced in noise reduction techniques. Due to the automatic analysis of the signal, the devices and methods do not require additional hardware or software for switching the technique on and off, as they only operate on the wind noise components when present. This technique may not be constrained by microphone cut-off frequencies typically encountered in real devices. This may be important as some other techniques rely solely on information below this frequency, whereas the devices and methods (e.g. the system) according to the present disclosure are robust to these microphone characteristics. The devices and methods may be used together with an existing Noise Reduction system by applying it as a separate step and as such can also be optimized and tuned separately. The devices and methods may have low complexity because of its modular implementation. They may have both low computational requirements and low memory requirements. These may be important advantages for battery operated devices. The techniques of the devices and methods may be extended to multi-microphone processing, where each microphone may be processed independently, due to the low coherence of wind noise between microphones. Moreover, many other acoustic enhancement techniques typically found in a communication link operate also in the frequency domain. For example, echo cancelers. This may allow for computationally efficient implementations by combining the frequency to time transforms of various processing modules in the audio subsystem.

The devices and methods provided may automatically analyze the scene to prepare for the detection of wind noise. They may perform a first stage of detection to identify and extract features which are associated with wind noise sources.

The devices and methods provided may distinguish the three cases of speech only, wind noise only and speech in wind noise. They may determine the current case from features extracted in the wind noise detection stage and this may be required for accurate noise power estimation.

The devices and methods provided may estimate the wind noise power. The wind noise power may be estimated by examining the spectral information surrounding the speech signal components and then performing polynomial fitting.

The devices and methods provided may reduce the level of the wind noise using the estimated wind noise power.

The devices and methods provided may result in a more comfortable listening experience by reducing the level of wind noises without the speech distortion that is commonly introduced in noise reduction techniques.

Figure 5:
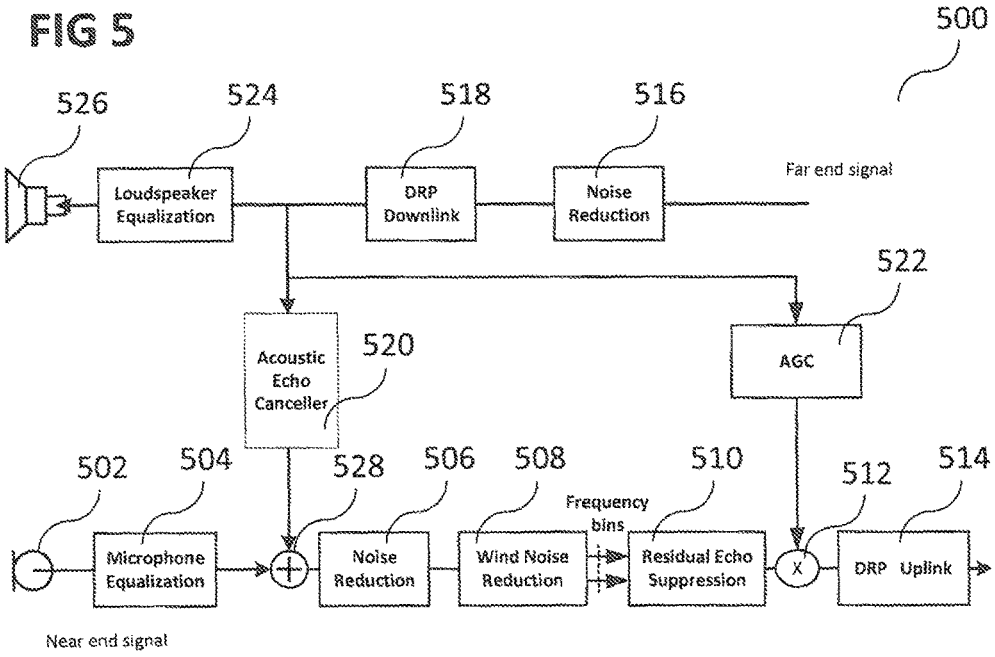
FIG. 5 shows an illustration of an integration of the wind noise reduction in a voice communication link.

FIG. 5 shows an illustration 500 of a (system) integration of the WNR in a voice communication link. The uplink signal from a microphone 502 (containing the noisy speech; the data acquired by the microphone 502 may be referred to as the near end signal), may be processed (e.g. first) by microphone equalization circuit 504 and a noise reduction circuit (or module) 506. The output may be input into the wind noise reduction device 508 (which may also be referred to as a WNR system). For example, the WNR may be combined with the frequency domain residual echo suppression circuit (or module), but if this module was not available, the WNR may have its own frequency-to-time transform. The other processing elements on the downlink, and acoustic echo canceller component are also shown for illustration purposes. For example, the wind noise reduction circuit 508 may output frequency bins to a residual echo suppression circuit 510. A multiplier 512 may receive input data from an AGC (automatic gain control) circuit 522 and the residual echo suppression circuit 510, and may provide output data to a DRP (Dynamic Range Processor) uplink circuit 514. A far end signal (for example received via mobile radio communication) may be input to a further noise reduction circuit 516, the output of which may be input into a DRP downlink circuit 518. The output of the DRP downlink circuit 518 may be input into an acoustic echo canceller 520 (which may provide its output to a summation circuit 528, which outputs its sum (further taking into account the output of the microphone equalization circuit 504) to the noise reduction circuit 506), the AGC circuit 522 and an loudspeaker equalization circuit 524. The loudspeaker equalization circuit 524 may provide its output to a loudspeaker 526. FIG. 5 illustrates an example of incorporating the WNR system 508 into a communication device.

In the following, signal statistics will be described.

Wind noise is mainly located at low frequencies (<500 Hz) and shows approximately a 1/f-decay towards higher frequencies. A speech signal may be divided into voiced and unvoiced segments. Voiced speech segments show a harmonic structure and the main part of the signal energy is located at frequencies between 0 and 3000 Hz. In contrast to that, unvoiced segments are noise-like and show a high-pass characteristic of the signal energy (>3000 Hz). This energy distribution leads to the fact that primarily voiced speech is degraded by wind noise. Thus, the noise reduction may only be applied on the lower frequencies (0-3000 Hz).

In the following, wind noise detection (WND) will be described.

For the WND, a robust feature is provided on which a classification of the current frame can be achieved. This feature is then mapped to perform the detection of the clean speech wind noise, or a soft decision on a mixture of the two previous cases.

In various aspects of the disclosure, subband signal centroids (SSC) may be exploited. SSCs may represent the spectral energy distribution of a signal frame $X(\lambda,\mu)$ and the SSC of the m-th subband is defined as:

$$SSC_m(\lambda) = \frac{\sum_{\mu=\mu_{m-1}+1}^{\mu_m} \mu \cdot |X(\lambda, \mu)|^2}{\sum_{\mu=\mu_{m-1}+1}^{\mu_m} |X(\lambda, \mu)|^2} \tag{1}$$

The frequency bins $\mu_m$ may define the limits between the subbands. For the system according to various aspects of this disclosure, only the centroid of the first subband $SSC_1$ covering the low frequency range (0-3000 Hz) may be considered. In that case:

$$\mu_0 = 0 \text{ and } \mu_1 = \left\langle \frac{3000 \text{ Hz}}{f_s} \cdot N \right\rangle,$$

where $f_s$ may be the sampling frequency, N may be the size of the FFT and < > may stand for rounding to the next integer. The $SSC_1$ may be seen as the "center-of-gravity" in the spectrum for a given signal.

The observations described with respect to the signal statistics may lead to the fact that $SSC_1$ is only affected by voiced speech segments and wind noise segments, whereas unvoiced speech segments have only marginal influence on the first centroid. For an ideal 1/f-decay of a wind noise signal, the $SSC_1$ value is constant and independent of the absolute signal energy.

Figure 6:
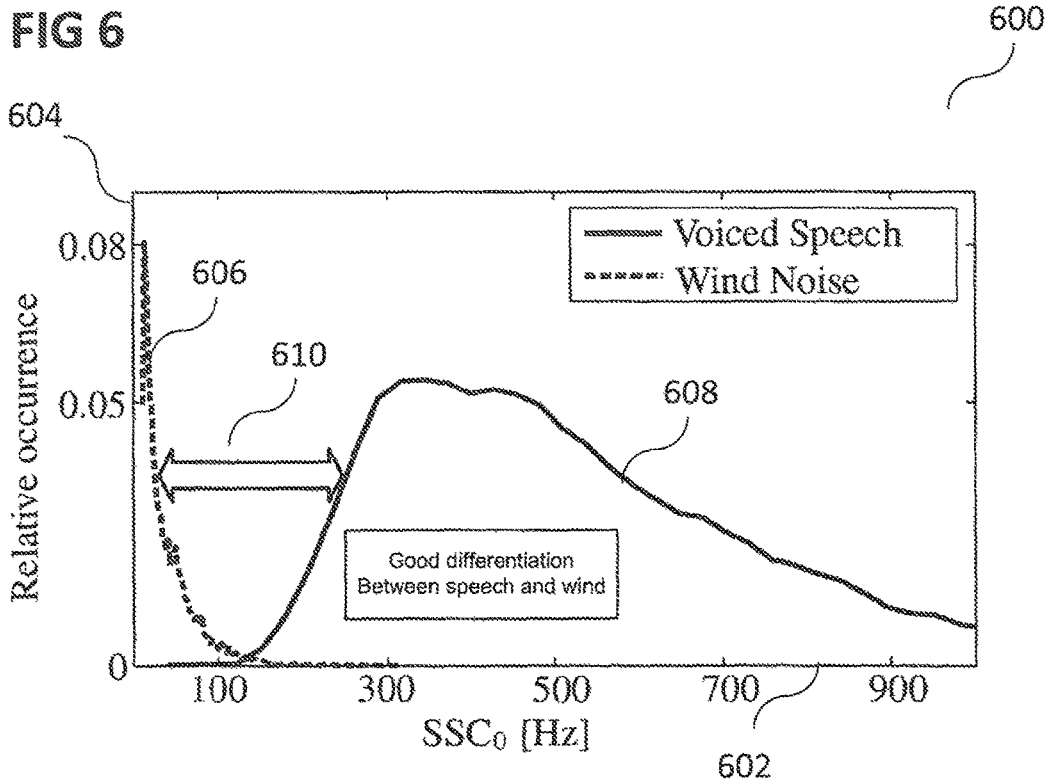
FIG. 6 shows a histogram of the first subband signal centroids $SSC_1$ for wind noise and voiced speech.

FIG. 6 shows a histogram 600 of the first SSC for wind noise and voiced speech. A horizontal axis 602 indicates the $SSC_1$, and a vertical axis 604 indicates the relative occurrence. A first curve 606 illustrates wind noise (shown as dashed line curve). A second curve 608 illustrates voiced speech (shown as solid line curve). FIG. 6 shows the distribution of the first signal centroids for wind noise 606 and voiced speech segments 608 in the histogram 600. For a clearer presentation the $SSC_1$ values are converted into the corresponding frequencies.

From FIG. 6 it can clearly be seen that the $SSC_1$ values for wind noise signals are concentrated below 100 Hz while voiced speech segments results into a distribution of the $SSC_1$ between 250 and 700 Hz. Based on the $SSC_1$ values, a threshold may be applied to detect pure wind noise or clean voiced speech segments. Typical values are between 100 and 200 Hz. Thus, like indicated by arrow 610, a good differentiation between speech and wind may be provided.

Figure 7:
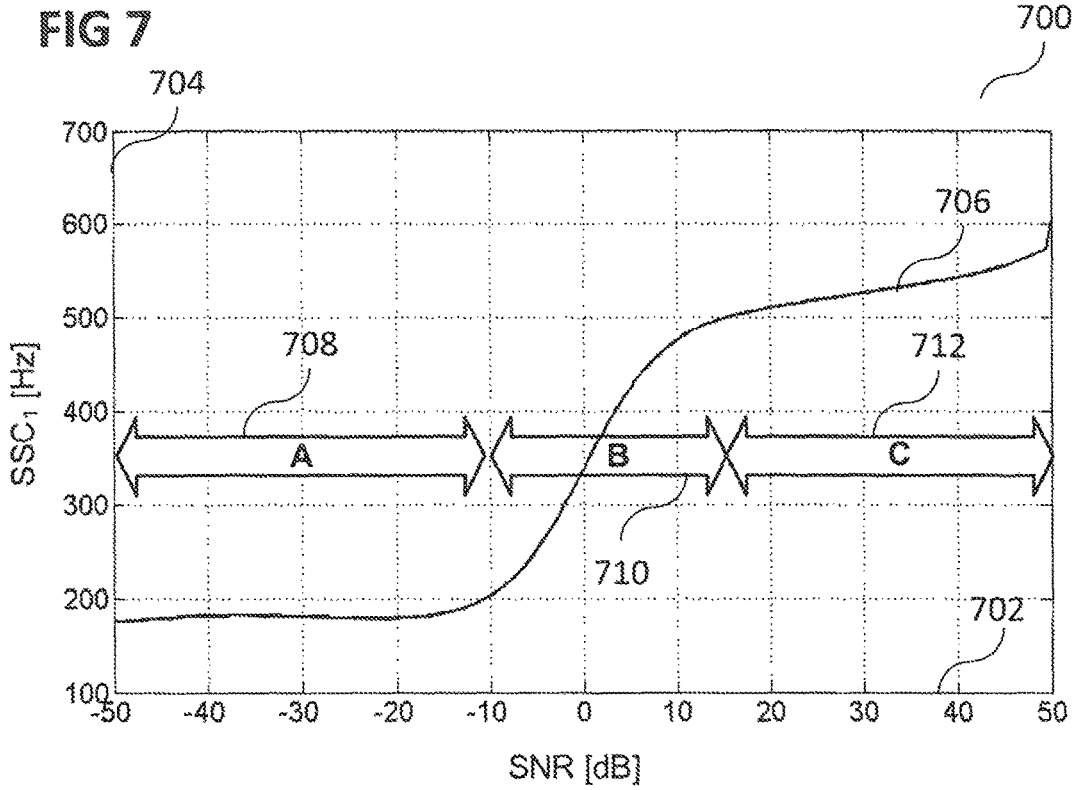
FIG. 7 shows an illustration of a $SSC_1$ of mixture of speech and wind.

FIG. 7 shows an illustration 700 of a $SSC_1$ of mixture of speech and wind. A horizontal axis 702 indicates the signal to noise ratio (SNR). A vertical axis illustrates $SSC_1$.

From FIG. 7 it can be seen that in real scenarios, however, there is also a transient region with a superposition of speech and wind. Therefore it is necessary not only to have a hard decision between the presence of voiced speech and wind noise. Additionally, a soft value gives information about the degree of the signal distortions. The resulting $SSC_1$ values of simulations with mixtures of voiced speech and wind noise at different signal-to-noise ratios (SNR) are depicted in FIG. 7.

The curve 706 can be divided into three ranges. For SNRs below −10 dB (A; 708) and above +15 dB (C; 712), the $SSC_1$ shows an almost constant value corresponding to pure wind noise (A; 708) and clean speech (C; 712), respectively. In between (B; 710) the curve shows a nearly linear progression. Concluding from this experiment, the $SSC_1$ value can be used for a more precise classification of the input signal.

In addition to the $SSC_1$, the energy ratio $ER(\lambda)$ between a two frequency bands can be used as a safety-net for the detection of clean voiced speech and pure wind noise. This is especially reasonable if the used microphones show a high-pass characteristic.

The energy ratio $ER(\lambda)$ may be defined as follows:

$$ER(\lambda) = \frac{\sum_{\mu_2}^{\mu_3} |X(\lambda, \mu)|^2}{\sum_{\mu_0}^{\mu_1} |X(\lambda, \mu)|^2} \tag{2}$$

The frequency bins $\mu_0$, $\mu_1$, $\mu_2$ and $\mu_3$ may define the frequency bins which limits the two frequency bands. If the limits $\mu_0$ and $\mu_1$ cover a lower frequency range (e.g. 0-200 Hz) than $\mu_2$ and $\mu_3$ (e.g. 200-4000 Hz), a high value of the energy ratio ($ER(\lambda)>>1$) indicates clean speech and a low value ($0<ER(\lambda)<1$) indicates wind noise. Typical values for these thresholds are $ER(\lambda)<0.2$ for the detection of pure wind noise and $ER(\lambda)>10$ for the detection of clean voiced speech.

In the following, wind noise estimation (WNEST) will be described.

As described above, the system according to various aspects of this disclosure provides an estimate of the wind noise PSD $\hat{\Phi}_n(\lambda,\mu)$. A PSD estimate $\hat{\Phi}_X(\lambda,\mu)$ of a given signal may be derived via recursive smoothing of consecutive signal frames $X(\lambda,\mu)$:

$$\hat{\Phi}_X(\lambda,\mu)=\alpha(\lambda)\cdot\hat{\Phi}_X(\lambda-1,\mu)+(1-\alpha(\lambda))\cdot|X(\lambda,\mu)|^2, \tag{3}$$

where the smoothing factor $\alpha(\lambda)$ may take values between 0 and 1 and can be chosen fixed or adaptive. The magnitude squared Fourier transform $|X(\lambda,\mu)|^2$ is called a periodogram. For the required wind noise PSD $\hat{\Phi}_n(\lambda,\mu)$ the periodograms of the noise $|N(\lambda,\mu)|^2$ signal are not directly accessible since the input signal contains both speech and wind noise. Hence for the system according to various aspects of this disclosure, the noise periodograms may be estimated based on the classification defined in the previous section. For the range where wind noise is predominant (A; for example 708 in FIG. 7), the input signal can directly be used as noise periodogram. In range (C; for example 712 in FIG. 7) where we assume clean speech, the noise periodogram is set to zero. For the estimation in the third range (B; for example 710 in FIG. 7) where both voiced speech and wind noise are active, a more sophisticated approach is used which exploits the spectral characteristics of wind noise and voiced speech.

As described above, the spectrum of wind noise may have a 1/f-decay. Thus, the wind noise periodograms may be approximated with a simple polynomial as:

$$|\hat{N}_{pol}(\lambda,\mu)|^2=\beta\cdot\mu^{\gamma}. \tag{4}$$

The parameters β and γ may be introduced to adjust the power and the decay of $|\hat{N}_{pol}(\lambda,\mu)|^2$. Typical values for the decay parameter γ lie between −2 and −0.5. For the computation of β and γ, two supporting points in the spectrum are required, and these may be assigned to the wind noise periodogram. In this design, the harmonic structure of voiced speech is exploited. The spectrum of a voiced speech segment exhibits local maxima at the so-called pitch frequency and multiples of this frequency. The pitch frequency is dependent on the articulation and varies for different speakers. Between the multiples of the pitch frequency, the speech spectrum reveals local minima where no or only very low speech energy is located. The spectra of a clean voiced speech segment and a typical wind noise segment are depicted in FIG. 8.

Figure 8:
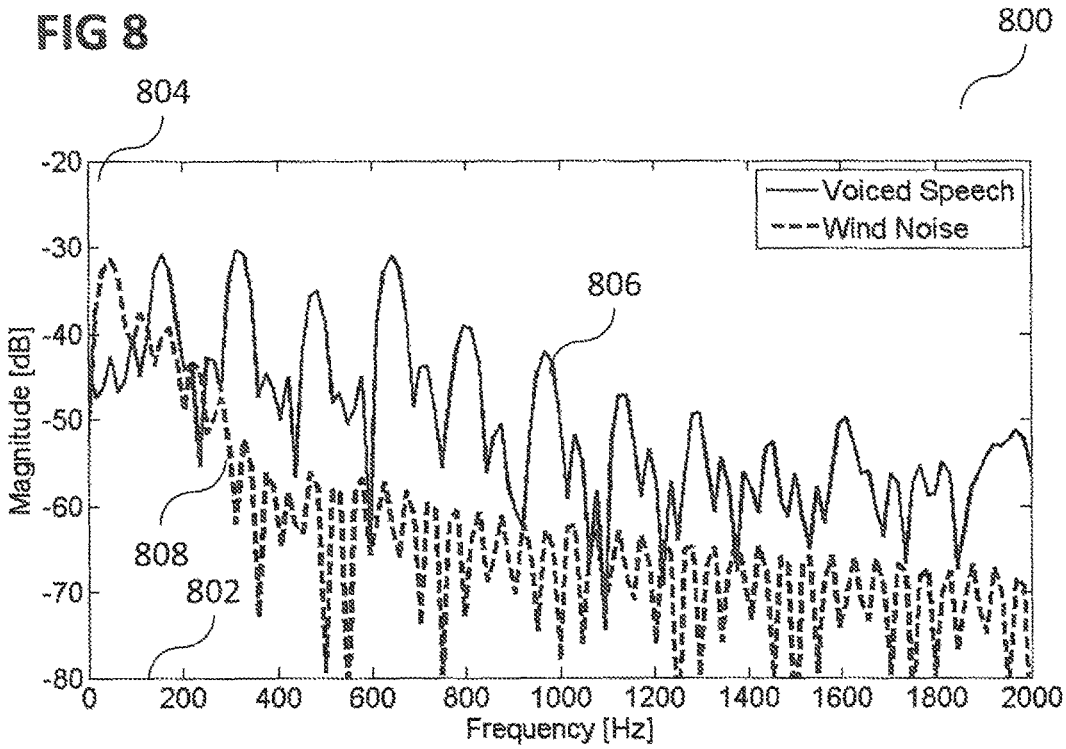
FIG. 8 shows an illustration of spectra of voiced speech and wind noise.

FIG. 8 shows an illustration 800 of spectra of voiced speech and wind noise. A horizontal axis 802 illustrates the frequency. A vertical axis 804 illustrates the magnitude. The harmonic structured spectrum of the speech is given by a first curve 806 (shown as a solid line curve), while the second curve 808 (shown as a dashed line curve) represents the wind noise spectrum.

For the estimation of the wind noise periodogram during voiced speech activity, two supporting points are required for the polynomial approximation in Eq. (4). This can be the first two minima as illustrated in FIG. 9.

Figure 9:
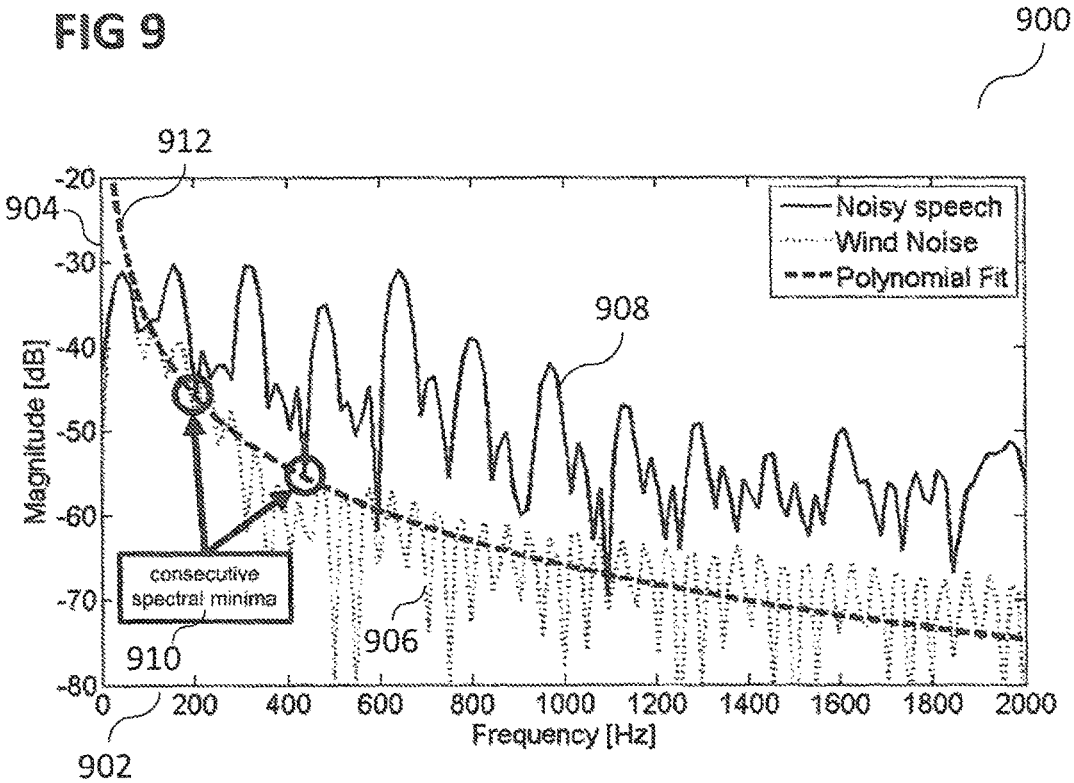
FIG. 9 shows an illustration of a polynomial approximation of a wind noise periodogram.

FIG. 9 shows an illustration 900 of a polynomial approximation of a wind noise periodogram. A horizontal axis 902 illustrates the frequency. A vertical axis 904 illustrates the magnitude. A noisy speech spectrum 908 (shown as a solid line curve) and a wind noise spectrum 906 (shown as a dotted line curve) are shown. Black circles depict local minima 910 of the noisy speech spectrum used for the polynomial approximation $|\hat{N}_{pol}(\lambda,\mu)|^2$ which is represented by a dashed line curve 912. It can be seen that $|\hat{N}_{pol}(\lambda,\mu)|^2$ results in a good approximation of the real wind noise spectrum.

Given two minima at the frequency bins $\mu_{min1}$ and $\mu_{min2}$, the parameter β and γ may be estimated as follows:

$$\gamma=\frac{\log\left(\frac{|X(\lambda,\mu_{min1})|^2}{|X(\lambda,\mu_{min2})|^2}\right)}{\log\left(\frac{\mu_{min1}}{\mu_{min2}}\right)} \tag{5}$$

and $$\beta=\frac{|X(\lambda,\mu_{min2})|^2}{\mu_{min2}\gamma} \tag{6}$$

In order to prevent an overestimation of the wind noise periodogram especially for low frequencies (<100 Hz), the calculated periodogram is limited by current periodogram as $$|\hat{N}'_{pol}(\lambda,\mu)|^2=\min(|\hat{N}_{pol}(\lambda,\mu)|^2,\ |\hat{X}(\lambda,\mu)|^2). \tag{7}$$

The calculation of the wind noise periodogram based on the current $SSC_1$ value may be summarized as:

$$|\hat{N}(\lambda,\mu)|^2=\begin{cases}|X(\lambda,\mu)|^2, & \text{if } SCC_1(\lambda)<\theta_1\\ |\hat{N}'_{pol}(\lambda,\mu)|^2, & \text{if } \theta_1<SCC_1(\lambda)<\theta_2\\ 0, & \text{if } SCC_1(\lambda)>\theta_2\end{cases} \tag{8}$$

$\theta_1$ and $\theta_2$ represent the thresholds of the $SSC_1$ values between the three ranges defined in FIG. 7. The thresholds can be set to 200 and 600 Hz as the corresponding frequencies for $\theta_1$ and $\theta_2$.

For the determination of the required wind noise PSD, the recursive smoothing given in Eq. (3) may be applied to the periodograms of Eq. (8). Here the choice of the smoothing factor α(λ) plays an important role. On one hand, a small smoothing factor allows a fast tracking of the wind noise but has the drawback that speech segments which are wrongly detected as wind noise have a great influence on the noise PSD. On the other hand, a large smoothing factor close to 1 reduces the effect of wrong detection during speech activity but leads to slow adaption speed of the noise estimate. Thus, an adaptive computation of α(λ) is favorable where low values are chosen during wind in speech pauses and high values during speech activity. Since the $SSC_1$ value is an indicator for the current SNR condition, the following linear mapping for the smoothing factor is used:

$$\alpha(\lambda)=\begin{cases}\alpha_{min}, & SSC_1(\lambda)<\theta_1\\ \frac{\alpha_{max}-\alpha_{min}}{\theta_2-\theta_1}\cdot SSC_1(\lambda)+\frac{\alpha_{min}\cdot\theta_2-\alpha_{max}\cdot\theta_1}{\theta_2-\theta_1}, & \theta_1<SSC_1(\lambda)<\theta_2\\ \alpha_{max}, & SSC_1(\lambda)>\theta_2\end{cases} \tag{9}$$

This relation between the smoothing factor α(λ) and the $SSC_1(\lambda)$ value leads to a fast tracking and consequently accurate noise estimate in speech pauses and reduces the risk of wrongly detecting speech as wind noise during speech activity. Furthermore a nonlinear mapping such as a sigmoid function can be applied for the relation between $SSC_1(\lambda)$ and α(λ).

In the following, noise reduction will be described.

The reduction of the wind noise may be realized by multiplication of the noisy spectrum X(λ,μ) with the spectral gains G(λ,μ). The spectral gains may be determined from the estimated noise PSD $\hat{\Phi}_n(\lambda,\mu)$ and the noisy input spectrum X(λ,μ) using the spectral subtraction approach:

$$G(\lambda,\mu)=\sqrt{1-\frac{\hat{\Phi}_n(\lambda,\mu)}{|X(\lambda,\mu)|^2}} \tag{10}$$

Microphones used in mobile device may show a high pass characteristic. This leads to an attenuation of the low frequency range which mainly affects the wind noise signal. This effect has influence on the wind noise detection and the wind noise estimation. This consideration may be integrated into a system to improve the robustness to the lower cut-off frequency of the microphone. The described system can be adapted as follows.

In the following, wind noise detection will be described. The energy distribution and consequently the signal centroids may be shifted towards higher frequencies. To adapt the wind noise reduction system, the thresholds $\theta_1$ and $\theta_2$ for the signal classification and the smoothing factor calculation may be modified. This may result in the modification of the smoothing factor from Eq. 9.

In the following, wind noise estimation will be described. The high pass characteristic of the microphone may result in low signal power below the cut-off frequency of the microphone. This may reduce the accuracy of the approximation as described above. To overcome this problem, the minima search described above may be performed above the microphone cut-off frequency.

In the following, a performance evaluation will be described.

Figure 10:
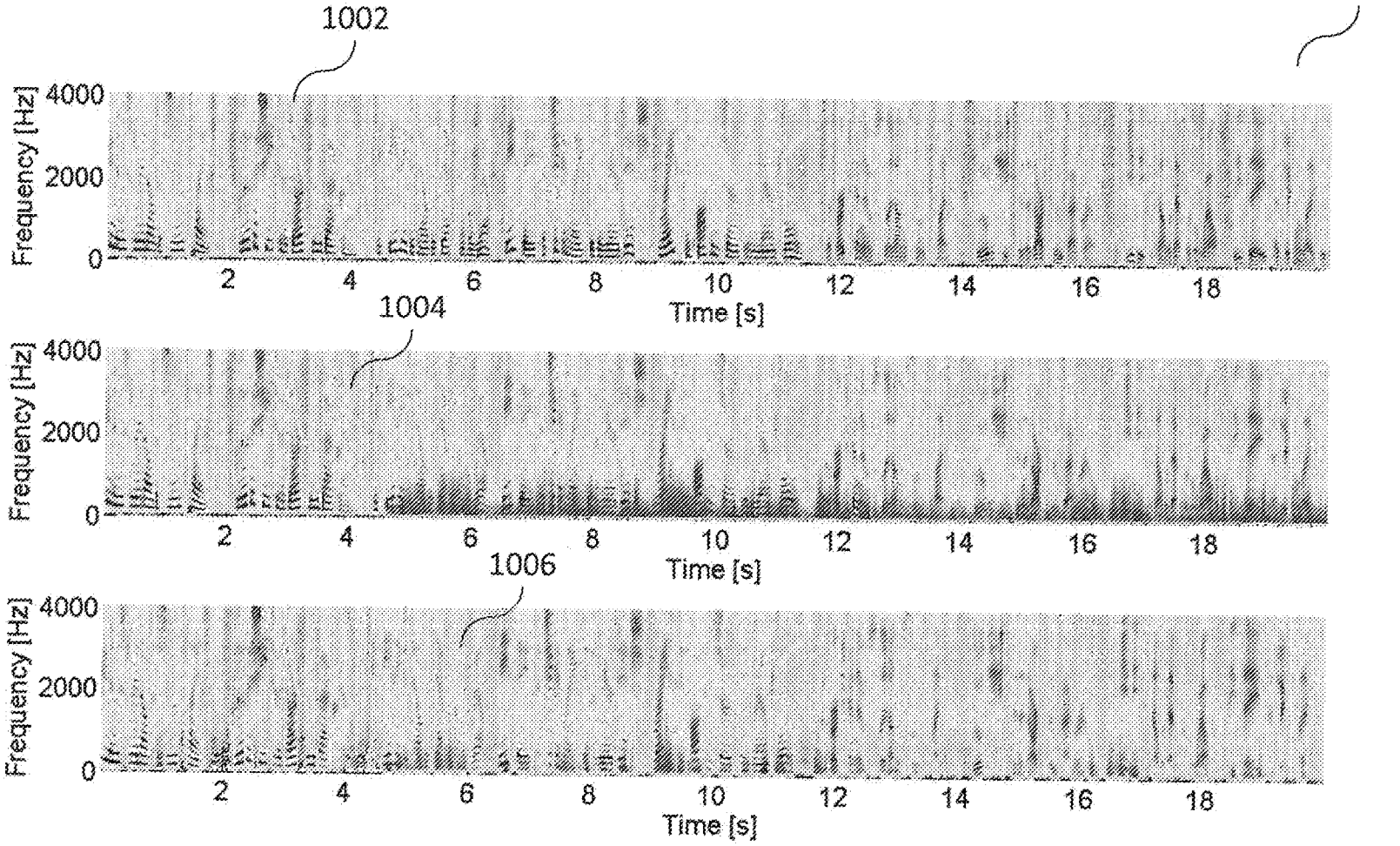
FIG. 10 shows an illustration of a demonstration of the system according to various aspects of this disclosure.

The performance of the system according to various aspects of this disclosure is demonstrated in FIG. 10.

FIG. 10 shows an illustration 1000 of a demonstration of the system according to various aspects of this disclosure. FIG. 10 shows three spectrograms of the clean speech signal (top; 1002), the noisy speech signal distorted by wind noise (middle; 1004) and the enhanced output signal of the system according to various aspects of this disclosure (bottom; 1006). It may be clearly seen that the effect of the wind noise in the lower frequency range can be reduced to a great amount.

The methods and devices according to various aspects of this disclosure are also compared to existing solutions for single microphone noise reduction. The evaluation considers the enhancement of the desired speech signal and the computational complexity. The performance of the investigated systems is measured by the noise attenuation minus speech attenuation (NA–SA) where a high value indicates an improvement. In addition, the Speech Intelligibility Index (SII) is applied as measure. The SII provides a value between 0 and 1, where a SII higher than 0.75 indicates a good communication system and values below 0.45 correspond to a poor system. To give an insight in the computational complexity, the execution time in MATLAB is measured.

The system according to various aspects of this disclosure was compared to commonly used systems for general noise reduction and two systems especially designed for wind noise reduction (which may be referred to as CB and MORPH, respectively). The system for the general noise reduction is based on the speech presences probability and may be denoted as SPP. The results are shown in FIG. 11.

Figure 11:
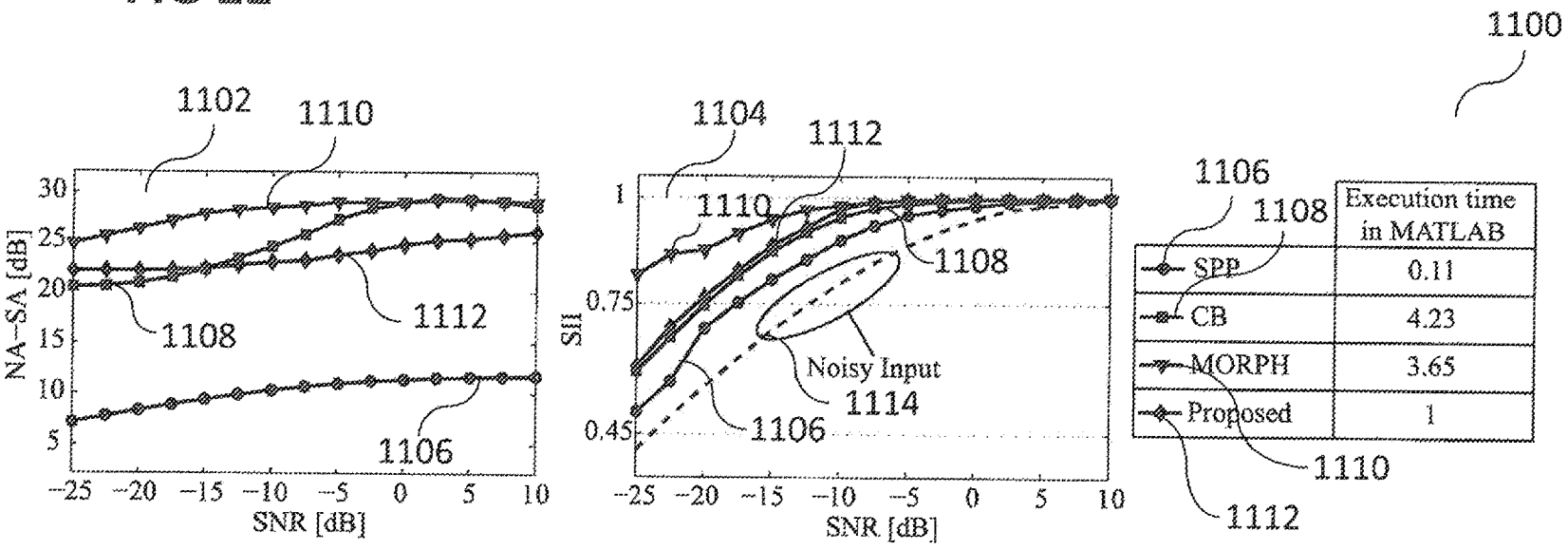
FIG. 11 shows an illustration of a comparison of the devices and methods according to various aspects of this disclosure with commonly used approaches.

FIG. 11 shows an illustration 1100 of a comparison of the devices and methods according to various aspects of this disclosure with commonly used approaches. A first diagram 1102 shows NA–SA over SNR. A second diagram 1104 shows SII over SNR. Data related to SPP is indicated by lines with filled circles 1106. Data related to CB is shown by lines with filled squares 1108. Data related to MORPH is indicated by lines with filled triangles 1110. Data related to the proposed devices and methods according to various aspects of this disclosure is indicated by lines with filled diamonds 1112. Noisy input is illustrated as a dashed line curve 1114.

The energy distribution of certain acoustical environment can be assumed as constant, and as such the system and methods according to various aspects of this disclosure can be used for a broad classification of acoustic environments. For example, it may be determined whether the acoustic environment is an acoustic environment in which wind is present or in which there is wind noise. The term "acoustical environment" as used herein may relate for example to an environment where wind noise is present or an environment where speech is present, but may not be related to different words or syllables or letters spoken (in other words: may not related to automatic speech recognition).

The following examples pertain to further embodiments.

Example 1 is an audio processing device comprising: an energy distribution determiner configured to determine an energy distribution of a sound; and an acoustical environment determiner configured to determine based on the energy distribution whether the sound includes a sound caused by the acoustical environment.

In example 2, the subject-matter of example 1 can optionally include that the acoustical environment comprises wind.

In example 3, the subject-matter of example 1 or 2 can optionally include: a spectrum determiner configured to determine a spectrum of the sound.

In example 4, the subject-matter of example 3 can optionally include that the spectrum determiner is configured to perform a Fourier transform of the sound.

In example 5, the subject-matter of example 3 or 4 can optionally include that the energy distribution determiner is further configured to determine a spectral energy distribution of the sound; and that the acoustical environment determiner is configured to determine based on the spectral energy distribution whether the sound includes a sound caused by the acoustical environment.

In example 6, the subject-matter of any one of examples 3-5 can optionally include that the energy distribution determiner is further configured to determine subband signal centroids of the sound; and that the acoustical environment determiner is configured to determine based on the subband signal centroids whether the sound includes a sound caused by the acoustical environment.

In example 7, the subject-matter of any one of examples 1-6 can optionally include that the energy distribution determiner is configured to determine a weighted sum of frequencies present in the sound; and that the acoustical environment determiner configured to determine based on the weighted sum whether the sound includes a sound caused by the acoustical environment.

In example 8, the subject-matter of any one of examples 1-7 can optionally include a cepstrum determiner configured to determine a cepstrum transform of the sound.

In example 9, the subject-matter of example 8 can optionally include that the acoustical environment determiner is configured to determine based on the cepstrum transform whether the sound includes a sound caused by the acoustical environment.

In example 10, the subject-matter of any one of examples 1-9 can optionally include an energy ratio determiner configured to determine a ratio of energy between two frequency bands.

In example 11, the subject-matter of example 9 can optionally include that the acoustical environment determiner is further configured to determine based on the energy ratio whether the sound includes a sound caused by the acoustical environment.

In example 12, the subject-matter of any one of examples 1-11 can optionally include that the acoustical environment determiner is further configured to classify the sound into one of the following classes: a sound where mainly sound caused by the acoustical environment is present; a sound where mainly sound caused by a further acoustical environment is present; or a sound where sound caused by a combination of the acoustical environment and the further acoustical environment is present.

In example 13, the subject-matter of example 12 can optionally include that the further acoustical environment comprises speech.

In example 14, the subject-matter of any one of examples 1-13 can optionally include a noise estimation circuit configured to estimate the noise in the audio signal.

In example 15, the subject-matter of example 14 can optionally include that the noise estimation circuit is configured to estimate the noise in the audio signal based on a power spectral density.

In example 16, the subject-matter of example 14 or 15 can optionally include that wind noise estimation circuit is further configured to approximate a noise periodogram with a polynomial.

In example 17, the subject-matter of any one of examples 14-15 can optionally include a noise reduction circuit configured to reduce noise in the audio based on the sound and based on the estimated noise.

In example 18, the subject-matter of any one of examples 1-17 can optionally include a sound input circuit configured to receive data representing the sound.

In example 19 is an audio processing method comprising: determining an energy distribution of a sound; and determining based on the energy distribution whether the sound includes a sound caused by a pre-determined acoustical environment.

In example 20, the subject-matter of example 19 can optionally include that the acoustical environment comprises wind.

In example 21, the subject-matter of example 19 or 20 can optionally include determining a spectrum of the sound.

In example 22, the subject-matter of example 21 can optionally include performing a Fourier transform of the sound.

In example 23, the subject-matter of example 21 or 22 can optionally include determining a spectral energy distribution of the sound; and determining based on the spectral energy distribution whether the sound includes a sound caused by the acoustical environment.

In example 24, the subject-matter of any one of examples 21-23 can optionally include determining subband signal centroids of the sound; and determining based on the subband signal centroids whether the sound includes a sound caused by the acoustical environment.

In example 25, the subject-matter of any one of examples 19-24 can optionally include determining a weighted sum of frequencies present in the sound; and determining based on the weighted sum whether the sound includes a sound caused by the acoustical environment wind.

In example 26, the subject-matter of any one of examples 19-25 can optionally include determining a cepstrum transform of the sound.

In example 27, the subject-matter of example 26 can optionally include determining based on the cepstrum transform whether the sound includes a sound caused by the acoustical environment.

In example 28, the subject-matter of any one of examples 19-27 can optionally include determining a ratio of energy between two frequency bands.

In example 29, the subject-matter of example 28 can optionally include determining based on the energy ratio whether the sound includes a sound caused by the acoustical environment.

In example 30, the subject-matter of any one of examples 19-29 can optionally include classifying the sound into one of the following classes: a sound where mainly sound caused by the acoustical environment is present; a sound where mainly sound caused by a further acoustical environment is present; or a sound where sound caused by a combination of the acoustical environment and the further acoustical environment is present.

In example 31, the subject-matter of example 30 can optionally include that the further acoustical environment comprises speech.

In example 32, the subject-matter of any one of examples 19-31 can optionally include estimating the noise in the audio signal.

In example 33, the subject-matter of example 32 can optionally include estimating the noise in the audio signal based on a power spectral density.

In example 34, the subject-matter of example 32 or 33 can optionally include approximating a noise periodogram with a polynomial.

In example 35, the subject-matter of any one of examples 32-34 can optionally include reducing noise in the audio based on the sound and based on the estimated noise.

In example 36, the subject-matter of any one of examples 19-35 can optionally include receiving data representing the sound.

Example 37 is an audio processing device comprising: an energy distribution determination means for determining an energy distribution of a sound; and an acoustical environment determination means for determining based on the energy distribution whether the sound includes a sound caused by the acoustical environment.

In example 38, the subject-matter of example 37 can optionally include that the acoustical environment comprises wind.

In example 39, the subject-matter of example 37 or 38 can optionally include a spectrum determination means for determining a spectrum of the sound.

In example 40, the subject-matter of example 39 can optionally include that the spectrum determination means comprises performing a Fourier transform of the sound.

In example 41, the subject-matter of example 39-40 can optionally include that the energy distribution determination means further comprises determining a spectral energy distribution of the sound; and that the acoustical environment determination means comprises determining based on the spectral energy distribution whether the sound includes a sound caused by the acoustical environment.

In example 42, the subject-matter of any one of examples 39-41 can optionally include that the energy distribution determination means further comprises determining subband signal centroids of the sound; and that the acoustical environment determination means comprises determining based on the subband signal centroids whether the sound includes a sound caused by the acoustical environment.

In example 43, the subject-matter of any one of examples 37-42 can optionally include that the energy distribution determination means comprises determining a weighted sum of frequencies present in the sound; and that the acoustical environment determination means comprises determining based on the weighted sum whether the sound includes a sound caused by the acoustical environment.

In example 44, the subject-matter of any one of examples 37-43 can optionally include a cepstrum determination means for determining a cepstrum transform of the sound.

In example 45, the subject-matter of example 44 can optionally include that the acoustical environment determination means comprises determining based on the cepstrum transform whether the sound includes a sound caused by the acoustical environment.

In example 46, the subject-matter of any one of examples 37-45 can optionally include an energy ratio determination means comprises determining a ratio of energy between two frequency bands.

In example 47, the subject-matter of example 46 can optionally include that the wind determination means further comprises determining based on the energy ratio whether the sound includes a sound caused by the acoustical environment.

In example 48, the subject-matter of any one of examples 37-47 can optionally include that the wind determination means further comprises classifying the sound into one of the following classes: a sound where mainly sound caused by the acoustical environment is present; a sound where mainly sound caused by a further acoustical environment is present; or a sound where sound caused by a combination of the acoustical environment and the further acoustical environment is present.

In example 49, the subject-matter of example 48 can optionally include that the further acoustical environment comprises speech.

In example 50, the subject-matter of any one of examples 37-49 can optionally include a noise estimation means for estimating the noise in the audio signal.

In example 51, the subject-matter of example 50 can optionally include that the noise estimation means comprises estimating the noise in the audio signal based on a power spectral density.

In example 52, the subject-matter of example 50 or 51 can optionally include that the noise estimation means further comprises approximating a noise periodogram with a polynomial.

In example 53, the subject-matter of any one of examples 50-52 can optionally include a noise reduction means for reducing noise in the audio based on the sound and based on the estimated noise.

In example 54, the subject-matter of any one of examples 37-53 can optionally include a sound input means for receiving data representing the sound.

In example 55 is a computer readable medium including program instructions which when executed by a processor cause the processor to perform a method for controlling a mobile radio communication, the computer readable medium further including program instructions which when executed by a processor cause the processor to: determining an energy distribution of a sound; and determining based on the energy distribution whether the sound includes a sound caused by an acoustical environment.

In example 56, the subject-matter of example 55 can optionally include that the acoustical environment comprises wind.

In example 57, the subject-matter of example 55 or 56 can optionally include program instructions which when executed by a processor cause the processor to perform: determining a spectrum of the sound.

In example 58, the subject-matter of example 57 can optionally include program instructions which when executed by a processor cause the processor to perform: performing a Fourier transform of the sound.

In example 59, the subject-matter of example 57 or 58 can optionally include program instructions which when executed by a processor cause the processor to perform: determining a spectral energy distribution of the sound; and determining based on the spectral energy distribution whether the sound includes a sound caused by the acoustical environment.

In example 60, the subject-matter of any one of examples 57 to 59 can optionally include program instructions which when executed by a processor cause the processor to perform: determining subband signal centroids of the sound; and determining based on the subband signal centroids whether the sound includes a sound caused by the acoustical environment.

In example 61, the subject-matter of any one of examples 55-60 can optionally include program instructions which when executed by a processor cause the processor to perform: determining a weighted sum of frequencies present in the sound; and determining based on the weighted sum whether the sound includes a sound caused by the acoustical environment.

In example 62, the subject-matter of any one of examples 55-61 can optionally include program instructions which when executed by a processor cause the processor to perform: determining a cepstrum transform of the sound.

In example 63, the subject-matter of example 62 can optionally include program instructions which when executed by a processor cause the processor to perform: determining based on the cepstrum transform whether the sound includes a sound caused by the acoustical environment.

In example 64, the subject-matter of any one of examples 55-63 can optionally include program instructions which when executed by a processor cause the processor to perform: determining a ratio of energy between two frequency bands.

In example 65, the subject-matter of example 64 can optionally include program instructions which when executed by a processor cause the processor to perform: determining based on the energy ratio whether the sound includes a sound caused by the acoustical environment.

In example 66, the subject-matter of any one of examples 55-65 can optionally include program instructions which when executed by a processor cause the processor to perform: classifying the sound into one of the following classes: a sound where mainly sound caused by the acoustical environment is present; a sound where mainly sound caused by a further acoustical environment is present; or a sound where sound caused by a combination of the acoustical environment and the further acoustical environment is present.

In example 67, the subject-matter of example 66 can optionally include that the acoustical environment comprises speech.

In example 68, the subject-matter of any one of examples 55-67 can optionally include program instructions which when executed by a processor cause the processor to perform: estimating the noise in the audio signal.

In example 69, the subject-matter of example 68 can optionally include program instructions which when executed by a processor cause the processor to perform: estimating the noise in the audio signal based on a power spectral density.

In example 70, the subject-matter of example 68 or 69 can optionally include program instructions which when executed by a processor cause the processor to perform: approximating a noise periodogram with a polynomial.

In example 71, the subject-matter of any one of examples 68-70 can optionally include program instructions which when executed by a processor cause the processor to perform: reducing noise in the audio based on the sound and based on the estimated noise.

In example 72, the subject-matter of any one of examples 55-71 can optionally include program instructions which when executed by a processor cause the processor to perform: receiving data representing the sound.

While specific aspects have been described, it should be understood by those skilled in the art that various changes in form and detail may be made therein without departing from the spirit and scope of the aspects of this disclosure as defined by the appended claims. The scope is thus indicated by the appended claims and all changes which come within the meaning and range of equivalency of the claims are therefore intended to be embraced.

The invention claimed is:

1. An audio processing device comprising:

an energy distribution determiner configured to determine an energy distribution of a sound and further configured to determine signal subband centroid values of the sound;

an acoustical environment determiner configured to compare the signal subband centroid values of the sound to a pre-determined static threshold and determine that the sound includes a sound caused by the acoustical environment when the subband signal centroid values are below the pre-determined static threshold; and a noise reduction circuit configured to reduce the sound caused by the acoustical environment in response to the comparison of the signal subband centroid values being below the pre-determined static threshold.

2. The audio processing device of claim 1, further comprising:

a spectrum determiner configured to determine a spectrum of the sound.

3. The audio processing device of claim 2, wherein the spectrum determiner is configured to perform a Fourier transform of the sound.

4. The audio processing device of claim 1, wherein the energy distribution determiner is further configured to determine a spectral energy distribution of the sound; and wherein the acoustical environment determiner is configured to determine based on the spectral energy distribution whether the sound includes a sound caused by the acoustical environment.

5. The audio processing device of claim 1, wherein the energy distribution determiner is configured to determine a weighted sum of frequencies present in the sound; and wherein the acoustical environment determiner configured to determine based on the weighted sum whether the sound includes a sound caused by the acoustical environment.

6. The audio processing device of claim 1, further comprising:

a cepstrum determiner configured to determine a cepstrum transform of the sound.

7. The audio processing device of claim 6, wherein the acoustical environment determiner is configured to determine based on the cepstrum transform whether the sound includes a sound caused by the acoustical environment.

8. The audio processing device of claim 1, further comprising:

an energy ratio determiner configured to determine a ratio of energy between two frequency bands.

9. The audio processing device of claim 8, wherein the acoustical environment determiner is further configured to determine based on the energy ratio whether the sound includes a sound caused by the acoustical environment.

10. The audio processing device of claim 1, wherein the acoustical environment determiner is further configured to classify the sound into one of the following classes:

a sound mainly caused by the acoustical environment is present;

a sound mainly caused by a further acoustical environment is present; or a sound caused by a combination of the acoustical environment and the further acoustical environment is present.

11. The audio processing device of claim 1, further comprising:

a noise estimation circuit configured to estimate the noise in the audio signal.

12. The audio processing device of claim 11, wherein the noise estimation circuit is configured to estimate the noise in the audio signal based on a power spectral density.

13. The audio processing device of claim 11, wherein the noise estimation circuit is further configured to approximate a noise periodogram with a polynomial.

14. The audio processing device of claim 11, wherein the noise reduction circuit is configured to reduce noise in the audio signal based on the sound and based on the estimated noise.

15. The audio processing device of claim 1, further comprising:

a sound input circuit configured to receive data representing the sound.

16. An audio processing method comprising:

determining an energy distribution of a sound;

determining signal subband centroid values of the sound;

comparing the signal subband centroid values of the sound to a pre-determined static threshold;

determining that the sound includes a sound caused by a pre-determined acoustical environment when the subband signal centroid values are below the pre-determined static threshold; and reducing, via a noise reduction circuit, the sound caused by the acoustical environment in response to the comparison of the signal subband centroid values being below the pre-determined static threshold.

17. The audio processing method of claim 16, further comprising:

determining a spectrum of the sound.

18. The audio processing method of claim 16, further comprising:

determining a spectral energy distribution of the sound; and determining based on the spectral energy distribution whether the sound includes a sound caused by the acoustical environment.

19. The audio processing method of claim 16, further comprising:

determining a weighted sum of frequencies present in the sound; and determining based on the weighted sum whether the sound includes a sound caused by the acoustical environment.

20. The audio processing method of claim 16, further comprising:

determining a ratio of energy between two frequency bands.

21. The audio processing method of claim 20, further comprising:

determining based on the energy ratio whether the sound includes a sound caused by the acoustical environment.

22. The audio processing method of claim 21, further comprising:

determining a spectrum of the sound.

23. A non-transitory computer readable medium including program instructions which, when executed by at least one processor, cause the at least one processor to perform:

determining an energy distribution of a sound;

determining signal subband centroid values of the sound;

comparing the signal subband centroid values of the sound to a pre-determined static threshold;

determining based on the energy distribution that the sound includes a sound caused by an acoustical environment when the subband signal centroid values are below the pre-determined static threshold; and reducing, via a noise reduction circuit, the sound caused by the acoustical environment in response to the comparison of the signal subband centroid values being below the pre-determined static threshold.

24. The non-transitory computer readable medium of claim 23, further including program instructions which, when executed by the at least one processor, cause the at least one processor to perform:

determining a spectrum of the sound.

25. The audio processing device of claim 1, wherein the sound caused by the acoustical environment is a sound caused by wind.

* * * * *